US006070428A

United States Patent [19]

Higashiyama et al.

[11] Patent Number: 6,070,428

[45] Date of Patent: Jun. 6, 2000

[54] STACK TYPE EVAPORATOR

[75] Inventors: Naohisa Higashiyama; Nobuyuki Okuda, both of Tochigi, Japan

[73] Assignee: Showa Aluminum Corporation, Osaka, Japan

[21] Appl. No.: 09/087,008

[22] Filed: May 29, 1998

[30] Foreign Application Priority Data

May 30, 1997 [JP] Japan ..... 9-142093
May 11, 1998 [JP] Japan ..... 10-127609

[51] Int. Cl.[7] ..... F25B 39/02

[52] U.S. Cl. ..... 62/525; 165/153

[58] Field of Search ..... 165/153, 167; 62/525

[56] References Cited

U.S. PATENT DOCUMENTS 5,448,899 9/1995 Ohara et al. ..... 62/525
5,517,757 5/1996 Hayashi et al. ..... 29/890.039
5,810,077 9/1998 Nakamura et al. ..... 165/153

*Primary Examiner*—William Wayner

[57] ABSTRACT

A stack type evaporator has a compact structure and a high cooling ability. A plurality of flat and plate-like tubular elements 1, each having a pair of formed plates 7, are stacked together in the lateral direction. Each tubular element 1 has two or more passages 10 inside it, each extending along the longitudinal direction. A refrigerant flows through a forward passage 10 in the tubular elements 1, and shifts to a return passage 10 in the direction opposed to the air flow. A corrugate inner fin 11 is placed throughout the refrigerant passages 10. One of the formed plate pair 7 has short cylindrical tanks 12*a* projecting outward, while the other has short cylindrical tanks 12*b* projecting outward, but in the opposite direction. When stacking up the tubular elements 1, the tanks 12*a* are fit into the corresponding tanks 12*b* of the adjacent formed plate 7 of the next tubular element 1.

6 Claims, 14 Drawing Sheets

STACK TYPE EVAPORATOR

BACKGROUND OF THE INVENTION

The present invention claims priority to patent application No. H9-142093 filed in Japan on May 30, 1997 and to patent application No. H10-127609 filed in Japan on May 11, 1998, the contents of which are incorporated herein by reference.

1. Field of the Invention

This invention relates to a stack type evaporator made of metal (e.g., aluminum), which is suitably used as an evaporator for an automobile air conditioner.

2. Description of the Related Art

Stack type evaporators are conventionally used in automobile air conditioners. Such a stack type evaporator generally comprises a plurality of flat and plate-like tubular elements, each consisting of a pair of formed plates which are put together facing each other. These flat tubular elements are stacked in the lateral direction with outer fins disposed between any adjacent two tubular elements.

Demands for compact and efficient stack type evaporators have arisen, and such evaporators have been developed. However, a demand for a further compact and highly efficient stack type evaporator is actually arising along with the advancement of technologies.

Therefore, it is an object of the invention to provide a compact and highly efficient stack type evaporator which responds to the current demand.

SUMMARY OF THE INVENTION

In order to achieve the object, the stack type evaporator according to the invention has a core body, which has a plurality of flat and plate-like tubular elements stacked in the thickness is direction with outer fins disposed between any two adjacent tubular elements, and short cylindrical tanks for connecting any two adjacent tubular elements in order to allow the inner spaces of the tubular elements to communicate with each other. Each of the flat tubular elements has a pair of formed plates having a tray-like shape, which are put together into one unit. The short tanks are formed near the ends of each formed plate so as to project outward when two formed plates are combined into a tubular element. When stacking the plurality of tubular elements, each of the short tanks formed in the formed plate is coupled with the corresponding one formed in the adjacent tubular element.

The end portion of the short tank formed in one of the formed plate pair is slightly tapered. When the tubular elements are stacked together, this tapered portion is fit into the corresponding tank formed in the adjacent tubular element so that the outer surface of the tapered end portion comes into contact with the inner surface of the receiving tank. This arrangement allows two facing tanks to be coupled easily. In addition, the entire tank part is made compact. Furthermore, the effective core area required for heat exchange between the refrigerant and the air is increased, while the pressure loss in the air is reduced.

BRIEF DESCRIPTION OF THE DRAWINGS

Other objects and features of the invention will be apparent from the following detailed description with reference to the attached drawings, wherein:

FIG. 1A is a front view, FIG. 1B is a right side view, FIG. 1C is a left side view, and FIG. 1D is a bottom view;

FIG. 2A is an inside plan view, FIG. 2B is a cross-sectional view taken along the 1—1 line shown in FIG. 2A, FIG. 2C is a cross-sectional view taken along the 2—2 line shown in FIG. 2A, and FIG. 2D is a partially enlarged plan view of the tubular element of FIG. 2A;

PREFERRED EMBODIMENTS OF THE INVENTION

Figure 1B:
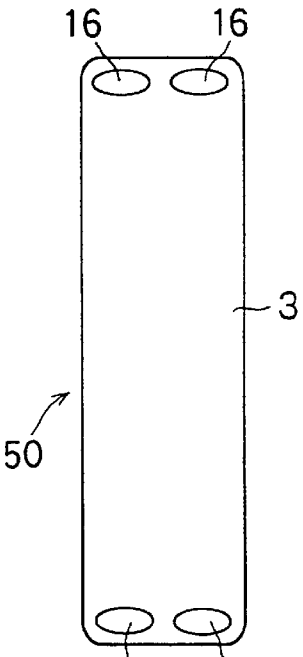
FIGS. 1A through 1D illustrate the stack type evaporator according to an embodiment of the invention, where
Figure 1A:
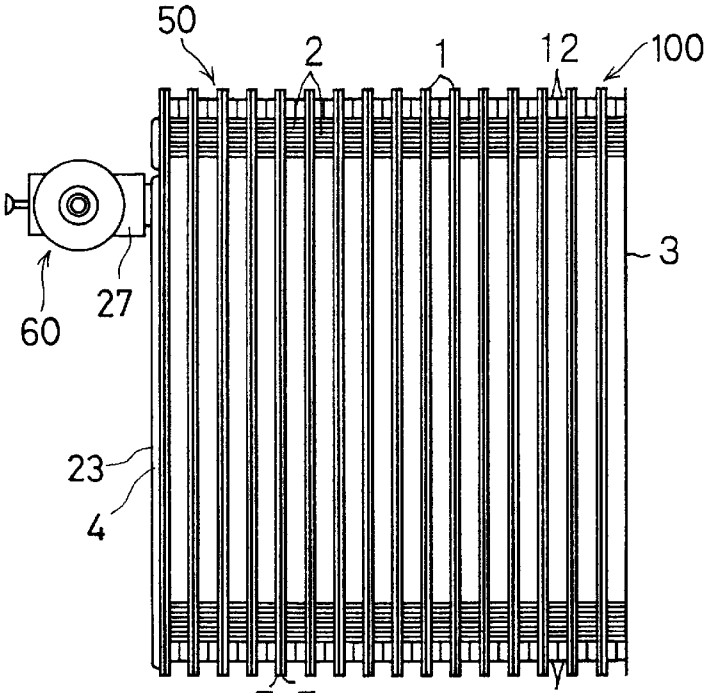

The preferred embodiments of the present invention will now be described with reference to the attached drawings.

FIGS. 1A–1D illustrate a stack type evaporator made of aluminum according to an embodiment, which comprises an evaporator core 100 and a block expansion valve 60 as essential elements.

The evaporator core 100 has a core body 50 as a major element, and an end plate unit 4 is provided to one side of the core body The core body 50 comprises a plurality of flat and plate-like tubular elements 1, and outer fins 2, which are, for example, corrugated fins. The tubular elements 1 are stacked in the thickness direction (i.e., in the lateral direction in FIG. 1A) with an outer fin 2 disposed between any two adjacent tubular elements.

A side plate 3 is attached to the last outer fin 2 (that is, the right side of the core body 50 in FIG. 1A) in order to protect the outermost fin 2.

The other side of the core body 50 (that is, the left side of the core body 50 in FIG. 1A) is covered with the end plate unit 4, whereby the first tubular element is protected.

Some of elements are made of aluminum brazing sheet, and the elements forming the evaporator core are joined together by brazing.

Figure 2D:
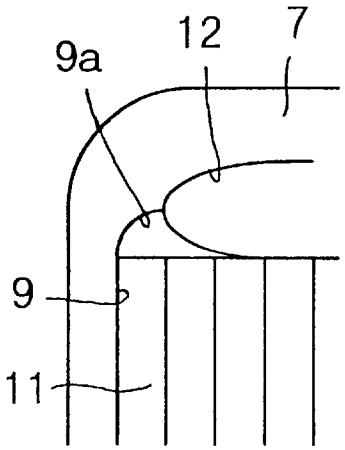
FIGS. 2A through 2D illustrate the plate-like tubular element used in the evaporator shown in FIG. 1, where
Figure 2A:
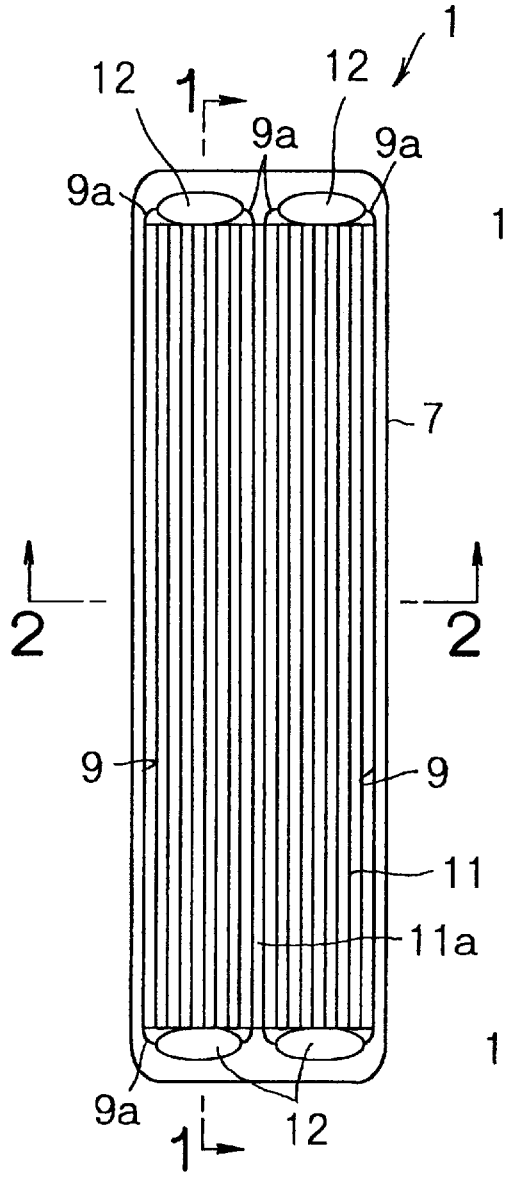
Figure 2B:
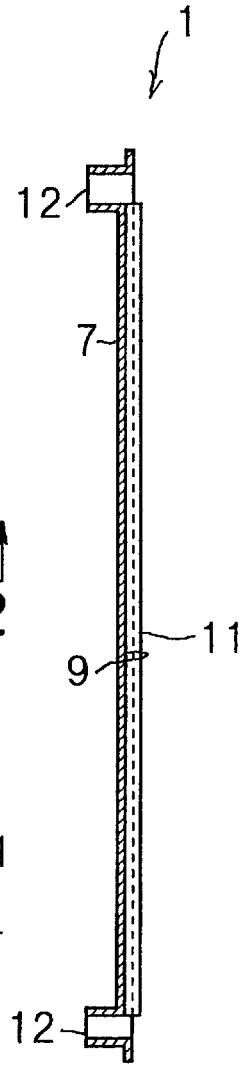
Figure 7C:
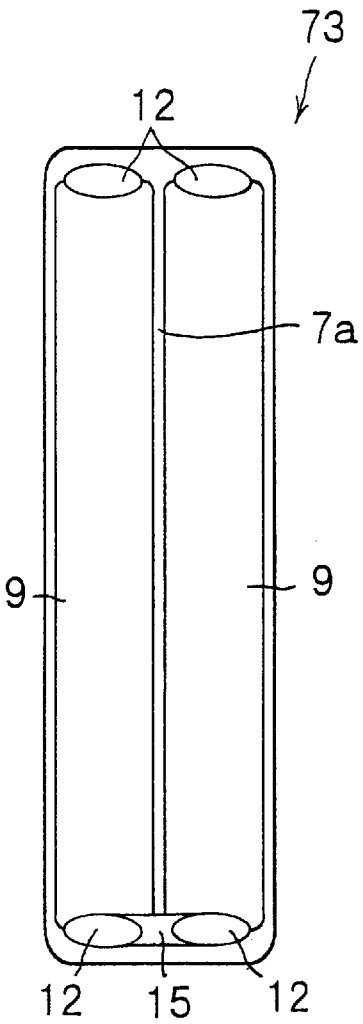
FIGS. 7A through 7C illustrate three types of formed plates used in the embodiment in plan views.
Figure 7B:
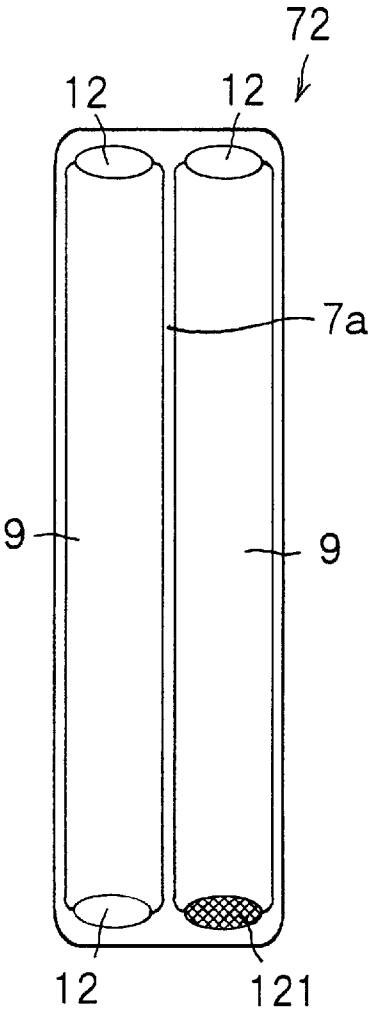
Figure 7A:
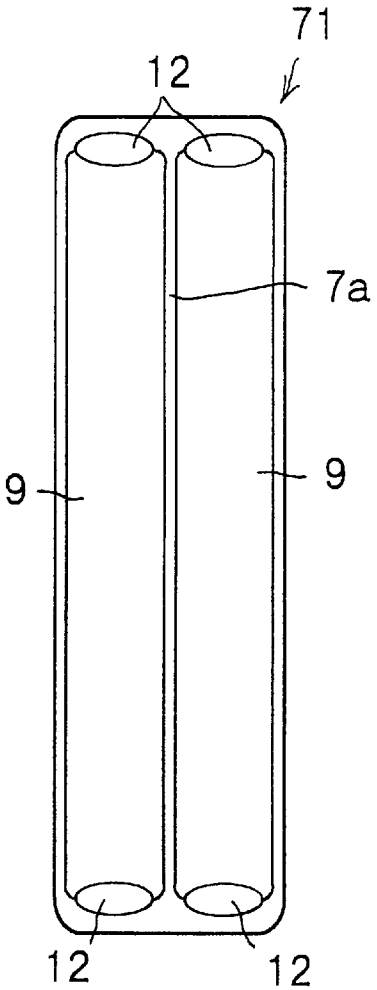

As shown in FIGS. 2A–2D the plate-like tubular element 1 used in the core body 50 consists of a pair of formed plates 7, which are put together so as to face each other. The formed plates 7 are made of, for example, aluminum brazing sheet manufactured by pressing. As shown in FIGS. 2A and 7A, the formed plate 7 has a rectangular shape, and two long recesses 9 are formed side by side by pressing so as to extend in the longitudinal direction with a boundary 7*a* between them. These recesses 9 define two refrigerant passages 10 when a pair of formed plates 7 are combined.

Figure 2C:
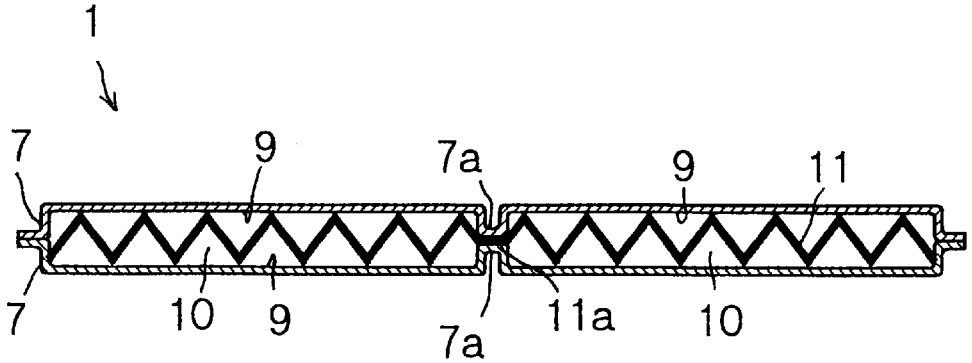

An inner fin 11 is placed throughout the refrigerant passages 10. The inner fin 11 is corrugated, as shown in FIG. 2C, for the purpose of increasing the heat-transfer area, and it is placed in the passages 10 so that the crests and the troughs repeat in the width direction of the tubular element 1 in order to prevent a pressure loss of the refrigerant. The inner fin 11 has a flat portion 11*a* extending in the longitudinal direction in the center of the fin 11. The height of the flat portion 11*a* is the middle of the crest and the trough. When assembling the two formed plates 7, the flat portion 11*a* of the inner fin 11 is sandwiched between the boundary areas 7*a* of the two formed plates 7, which partition the two refrigerant passages 10, whereby the inner fin 11 is appropriately positioned in the width direction in the tubular element 1. As shown in FIGS. 2A and 2D, the four corners of each recess 9 are rounded, and inwardly curved walls 9*a* are formed. The edges of the inner fin 11 abut against these curved walls 9*a*, whereby the inner fin 11 is again appropriately positioned in the longitudinal direction in the tubular element 1.

Figure 3:
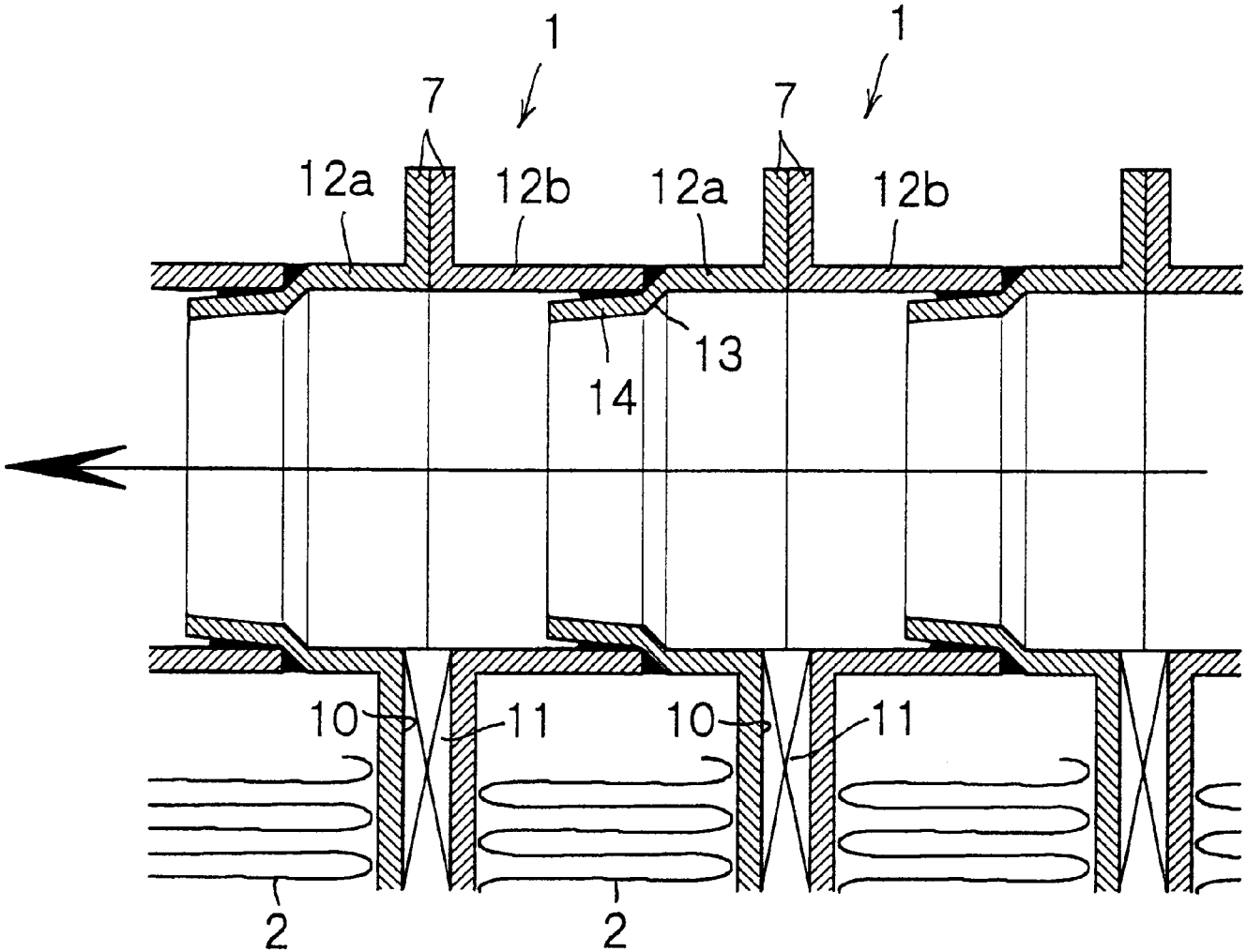
FIG. 3 shows how the tanks are connected to each other in a cross-sectional view.

Four tanks 12 are formed in each formed plate 7 at both ends of the respective recesses 9 by pressing. The tanks 9 are flat pipes having an elliptical cross-section, which extend exceeding the depth of the recess 9. As shown in FIG. 3, when two formed plates are combined, the tanks 9 project outward from the flat surfaces of the tubular element 1. When the tubular elements 1 are stacked, the tanks 12*a* of one formed plate 7 of the tubular element 1 are connected to the corresponding tanks 12*b* of the adjacent formed plate 7 of the next tubular element 1, thereby allowing the refrigerant to flow through the tubular elements 1. FIG. 3 shows in detail how these tanks are connected to each other.

As shown in FIG. 3, each of the flat cylindrical tanks 12*a* formed in one formed plate 7 of a tubular element 1 has a shoulder 13 in the middle of the flat cylinder. The end portion 14 of the tank 12*a* is slightly tapered from the shoulder 13 for the purpose of facilitating the brazing process. Thus, the major axis and the minor axis of the elliptical cross-section of the end portion 14 are slightly smaller than those of the base portion of the tank 12*a*. The tapered end portion 14 of the tank 12*a* is fit into the corresponding tank 12*b* of the adjacent formed plate 7 of the next tubular element 1, and these tanks 12*a* and 12*b* are brazed. Although the cross-sectional area of the connected portion of the tanks 12*a* and 12*b* is slightly narrower than that of the base portion, the cross-sectional area of the tank passage is substantially uniform, thereby allowing a smooth flow of the refrigerant. This arrangement can also increase the effective core area required for heat exchange between the refrigerant and the air and, at the same time, pressure losses in both the air and the refrigerant can be reduced. Thus, a compact and high-performance .evaporator can be achieved. The tanks 12*a* and 12*b* are appropriately positioned by pressing the edge of the tank 12*b* against the shoulder 13 of the tank 12*a*.

Figure 5:
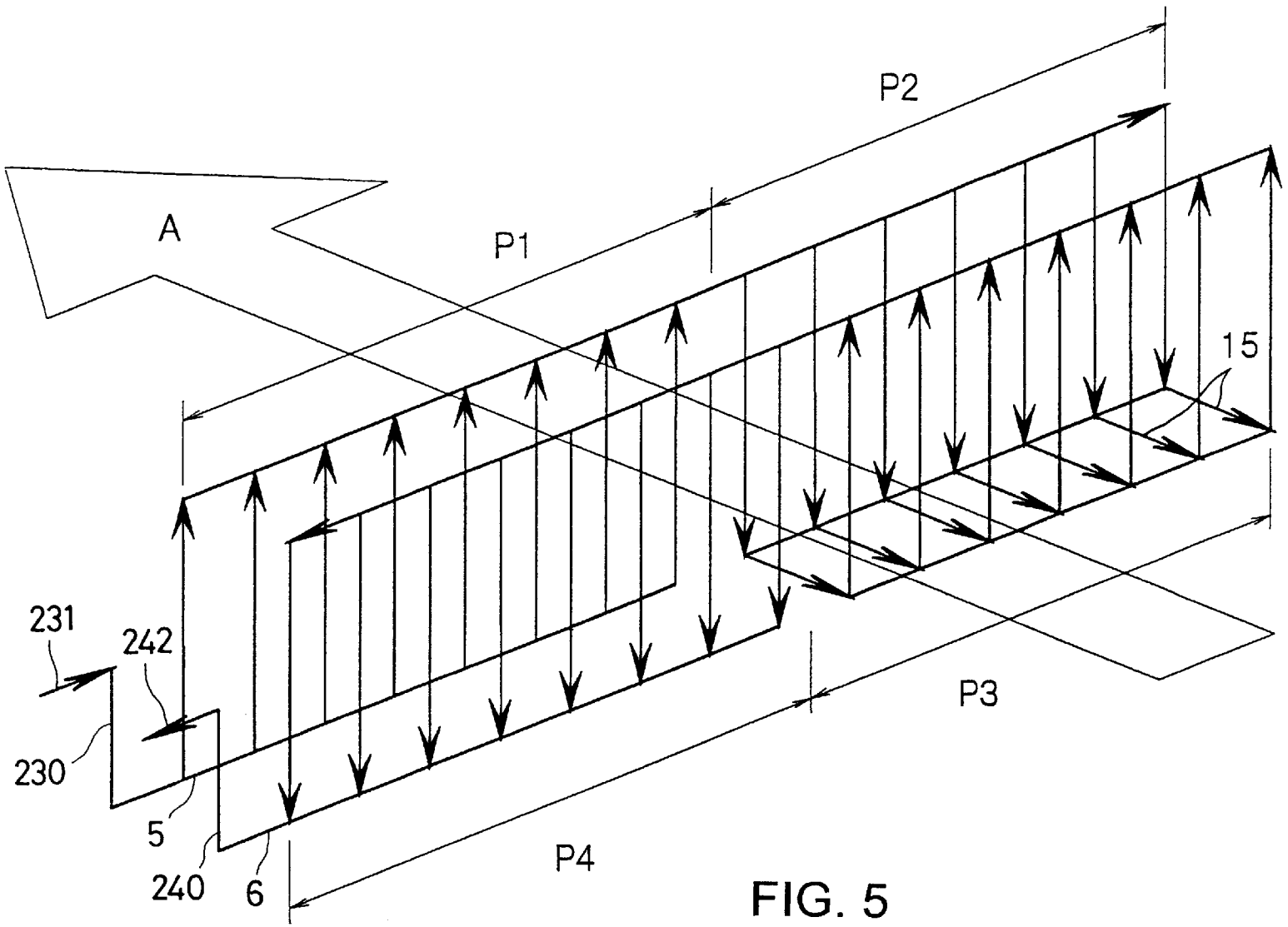
FIG. 5 shows the refrigerant flow path of the stack type evaporator according to the embodiment in a perspective view.

FIG. 5 shows the refrigerant flow path of the core body 50. The refrigerant is introduced from the inlet port 5, which will be described in more detail below. The air flow through the evaporator is indicated by the arrow A. The refrigerant flows up in one side (i.e., the left side in FIG. 5) of the downstream path P1 with respect to the air flow, and goes down in the other side (i.e., the right side in FIG. 5) of the down stream path P2. Then, the refrigerant flows into the upstream path, goes up in the right side path P3, and goes down in the left side path P4. Thus, the refrigerant flows along a zigzag path in the evaporator, and flows out of the exit port 60, which will also be described below.

Figure 6:
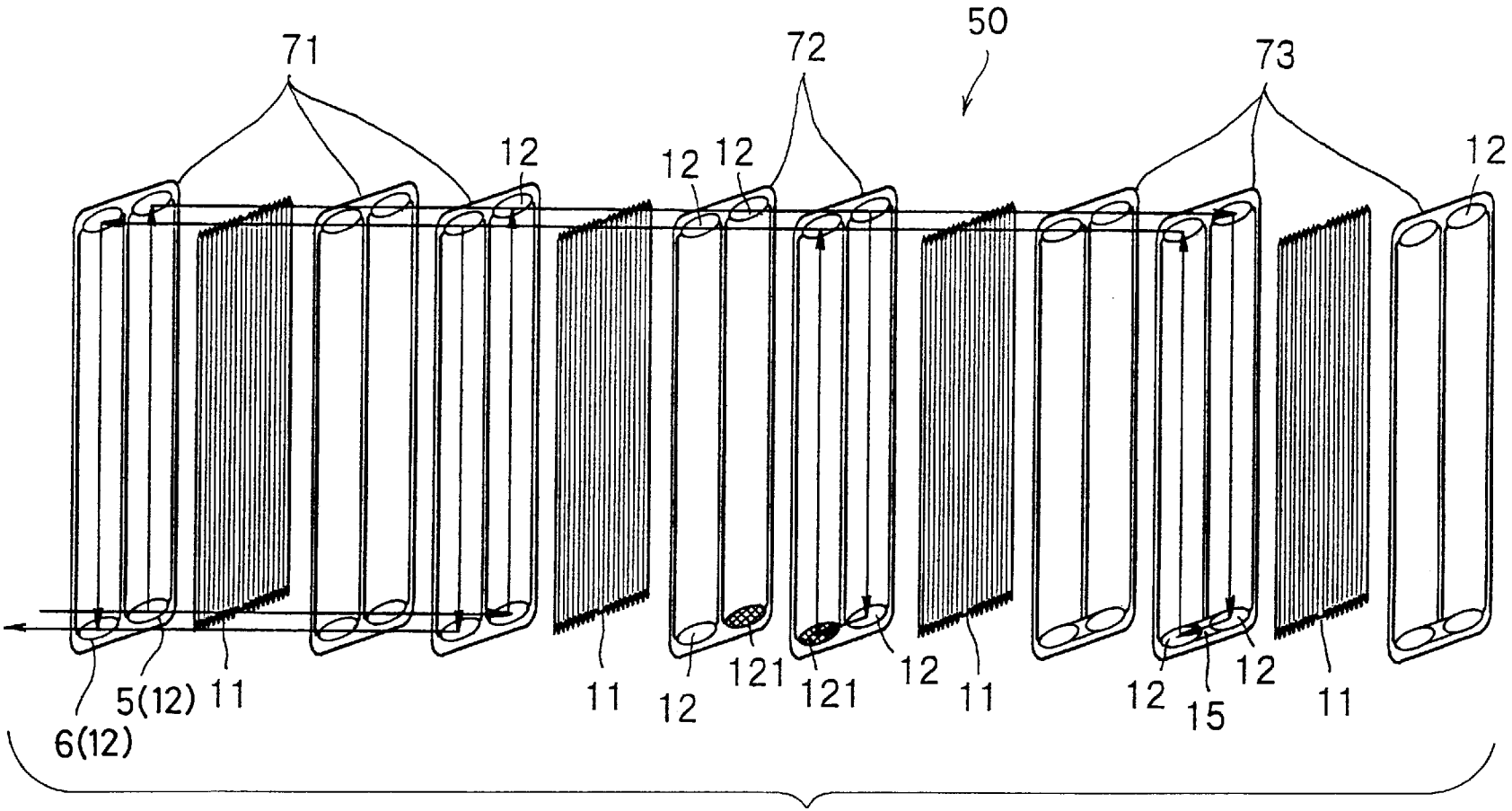
FIG. 6 is a an exploded perspective view of the stack type evaporator, from which the outer fins are omitted.

In order to achieve this zigzag path, three types of formed plates 7 are used to make the tubular elements 1. FIGS. 6 and 7 illustrate three types of formed plates 71, 72 and 73. As shown in FIG. 7A, the four tanks 12 of the first formed plate 71 are all open, and two adjacent tanks 12 on each end of the plate 71 are separated without communication between them.

The second formed plate 72 has a partitioning function in order to change the vertical direction of the refrigerant flow. As shown in FIG. 7B, one of the four tanks 12 is blocked by a blind. The blocked tank is denoted by numerical symbol 121.

The third formed plate 73 is used to send the refrigerant from. a downstream tubular element to the upstream tubular element. As shown in FIG. 7C, two tanks 12 formed in one end of the plate 7 communicate with each other via the passage 15.

FIG. 6 is an exploded view of the evaporator core 100, which shows how these three types of formed plates are arranged in the core body 50. As shown in FIG. 6, two second formed plates 72 are used in the middle two tubular elements 1, each in one of the tubular elements 1, and they are arranged so as to face each other. In other words, a second formed plate 72 is used as one of the plate pair of the middle tubular element 1, while the other one is used as one of the plate pair of the adjacent tubular element 1, and the two second formed plates 72 are next to each other. These two second formed plate 72 have the same structure, and both are placed so that their blinded tanks 121 are down, whereby the bottom two tanks 121 which connect two middle tubular elements 1 are blocked. The other of the formed plate pair of one of the middle two tubular elements 1 (i.e., the left one in FIG. 7) is a first formed plate 71. On the other hand, the other of the formed plate pair of the other tubular element 1 (i.e., the right one in FIG. 7) is a third formed plate 73.

The third formed plate 73 is placed with the connection passage is downward. The bottom two tanks 12 of the leftmost tubular element 1 are used as the refrigerant inlet port 5 and the refrigerant exit port 6, respectively. In the example shown in FIG. 7, the front bottom tank 12 is used as the exit port 6, and the rear bottom tank 12 is used as the inlet port 5.

This arrangement allows the refrigerant to flow along the path shown in FIG. 5, that is, to rise in the left half path P1 of the downstream recesses, go down in the right half path P2 of the downstream recesses, shift to the upstream recesses via the tank connection passages 15, rise in the right half path P3, and go down in the left half path P4. Thus, the refrigerant shifts from the down stream paths P1 and P2 to the upstream paths P3 and P4 against the air flow. This flow path of the refrigerant can increase the heat exchange rate and, accordingly, the cooling ability of the evaporator can be improved.

In addition, because the first path Pl faces the last path P4, while the second path P2 faces the third path P3, the temperature difference of the air flowing through the evaporator core 100 in the direction A (FIG. 5) between the left half and the right half of the laterally stacked tubular elements 1 can be greatly reduced, whereby efficient heat exchange can be achieved.

Figure 8:
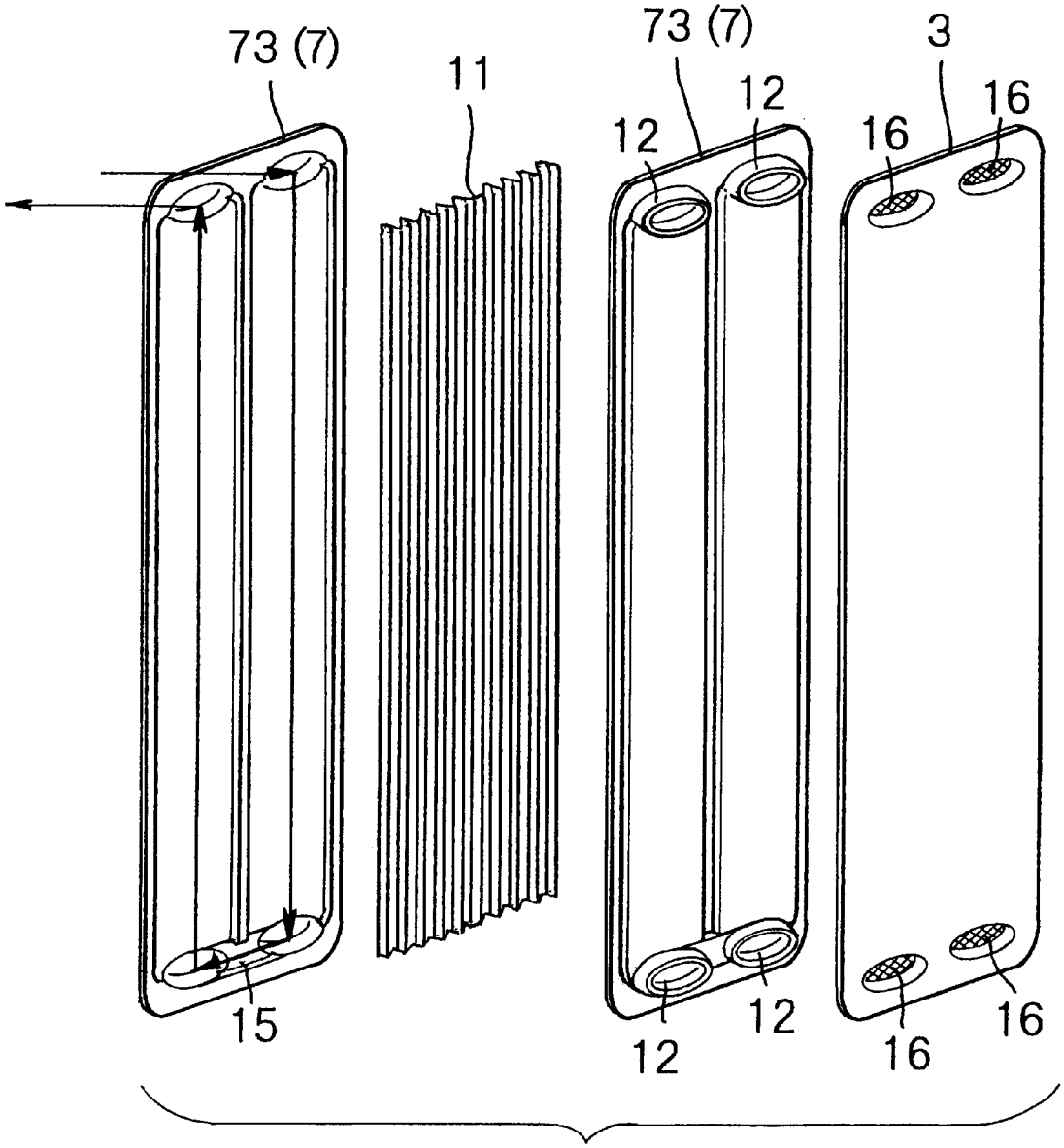
FIG. 8 is an exploded perspective view of the side plate used in the embodiment, from which the outer fins are omitted.

With this arrangement, the four tanks 12 of the rightmost plate 73 must be blocked in order to complete the refrigerant flow path and, in the embodiment, a side plate 3 is used to block these tanks 12. As shown in FIG. 8, the side plate 3 is a rectangular plate having the same dimensions as those of the formed plate 7. Four pipes 16 are formed by pressing in the side plate 3 at the positions corresponding to the tanks 12 of the formed plate 7, all. of which are blocked by blinds. The pipes 16 of the side plate 3 are fit into the tanks 12 of the rightmost formed plate 7. This side plate 3 has double functions of protecting the outermost fin 2 and capping the tanks 12 of the outermost (i.e., the rightmost in FIG. 8) formed plate 7, whereby the number of elements used in the evaporator can be reduced. The types of formed plates 7 used in the evaporator can also be reduced to only three types 71, 72 and 73.

Figure 9:
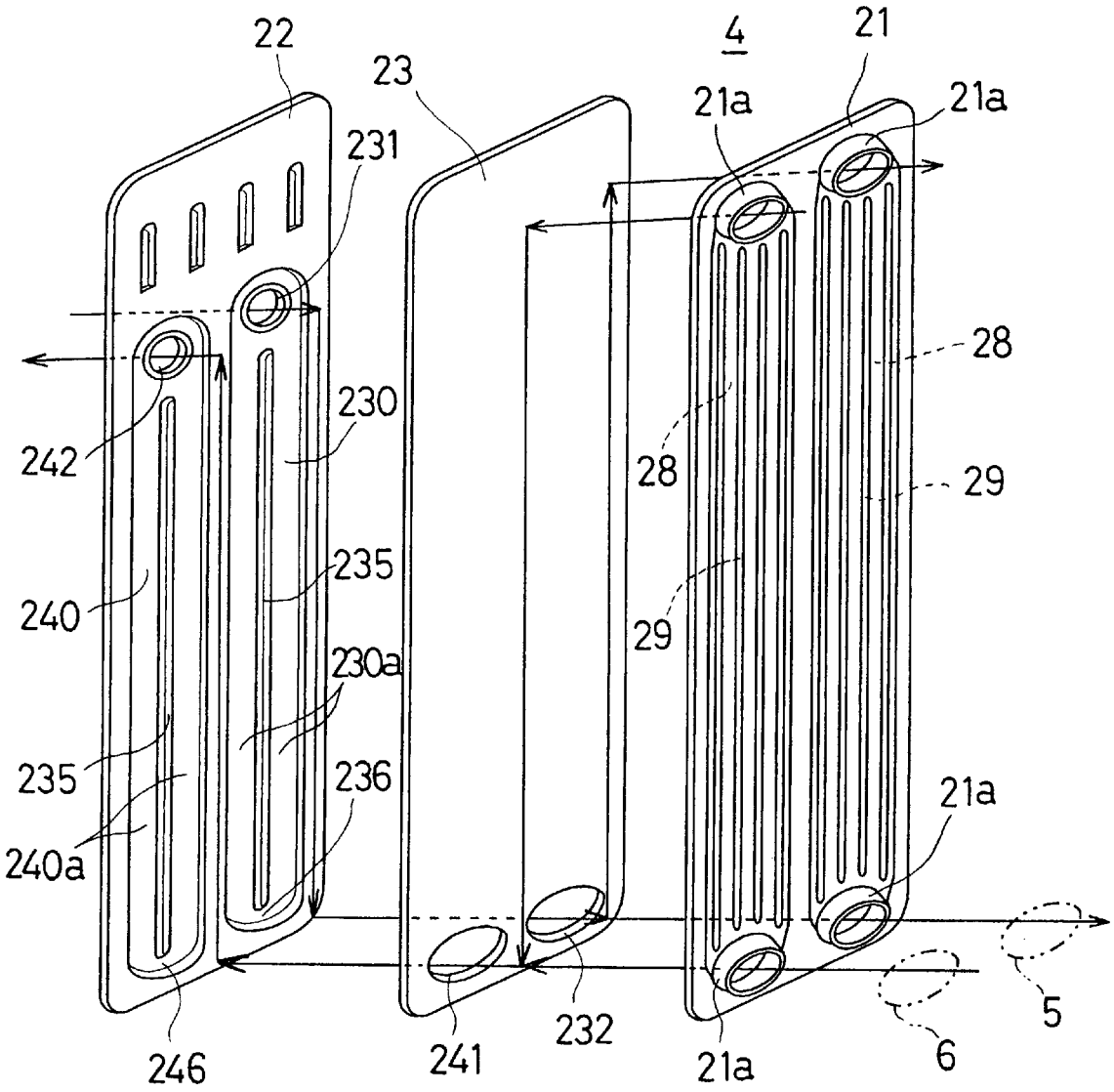
FIG. 9 is an exploded perspective view of the end plate unit used in the embodiment.
Figure 10:
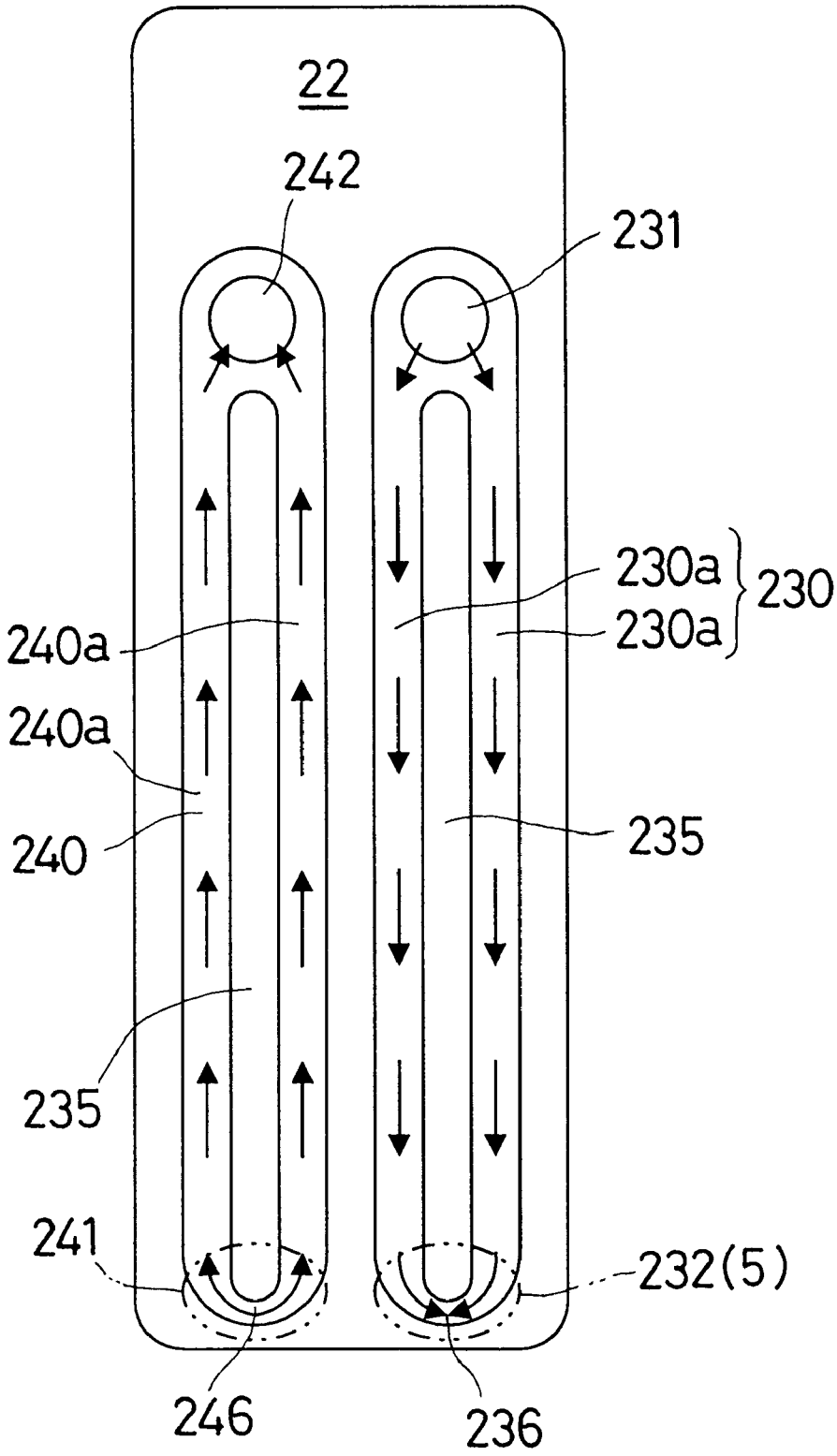
FIG. 10 is an inside plan view of the outer end plate used in the end plate unit shown in FIG. 9.

The other end (i.e., the left end) of the evaporator is covered with an end plate unit 4 which is shown in FIG. 9. The end plate unit 4 comprises an inner end plate 21, an outer end plate 22, and a middle end plate 23, all of which are rectangular plate having the same dimensions.

The inner end plate 21 is made from aluminum brazing sheet by pressing, like the formed plates 7. The inner end plate 21 has two recesses 28 formed side by side along the longitudinal direction. The recesses 28 define a part of the refrigerant flow passage. Four tanks 21*a* are formed by pressing at both ends of the respective recesses 29. The tanks 21*a* project exceeding the depth of the recesses 28. A plurality of ribs 29 are formed in the recesses 28 so as to project toward the middle end plate 23 for the purpose of guiding the refrigerant.

The outer end plate 22 has a forward refrigerant input port 231 and a return refrigerant output port 242 in the upper part thereof. Two recesses 230 and 240, which are formed by pressing, extend from the forward refrigerant input port 231 and the return refrigerant output port 242, respectively. These recesses 230 and 240 face the recesses 28 of the inner end plate 21 via the middle plate 23.

Partition ribs 235 and 245 extend in the recesses 230 and 240 respectively, along the longitudinal direction, and opening passages 236 and 246 are formed at the bottom of the partition ribs 235 and 245.

The middle plate 23 has a forward refrigerant output port 232, which communicates with the recesses 230 that defines a forward refrigerant passage, and a return refrigerant input port 241 which communicates with the recesses 240 that defines a return refrigerant passage, at the bottom.

The inner and outer end plates 21 and 22 are put together with the middle plate 23 sandwiched between them. The inner end plate 21 and the middle end plate 23 define the front and rear refrigerant passages 28, while the outer end plate 22 and the middle end plate 23 define the forward refrigerant passage 230, which is positioned toward the rear in FIG. 9, and a return refrigerant passage 240, which is positioned toward the front in FIG. 9.

The forward passage 230 is divided into two sub-passages 230*a* by the partition 235, while the return passage 240 is divided into two sub-passages 240*a* by the partition 245. The sub-passages 230*a* communicate each other via the opening passage 236, while the sub-passages 240*a* communicate each other via the opening passage 246.

The end plate unit 4 is stacked to the leftmost tubular element 1 with an outer fin 2 disposed between them. In other words, the inner end plate 21 of the end plate unit 4 and the formed plate 7 of the leftmost tubular element 1 sandwich the outer fin 2. The pipes 21*a* of the inner end plate 21 are fit into the tanks 12 of the leftmost formed plate 7 to connect the refrigerant flow passage.

As shown in FIG. 1, a flange 27 is connected to the upper portion of the outer end plate 22 so as enclose the forward refrigerant input port 231 and the return refrigerant output port 242.

Figure 1C:
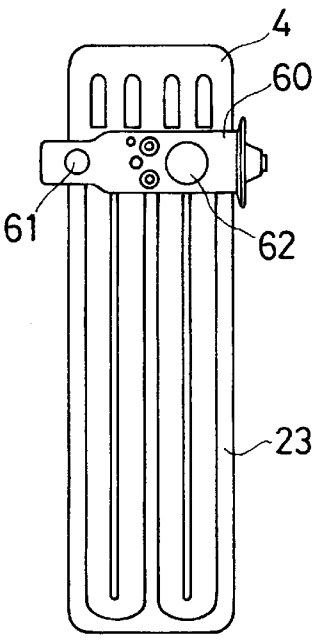
Figure 1D:
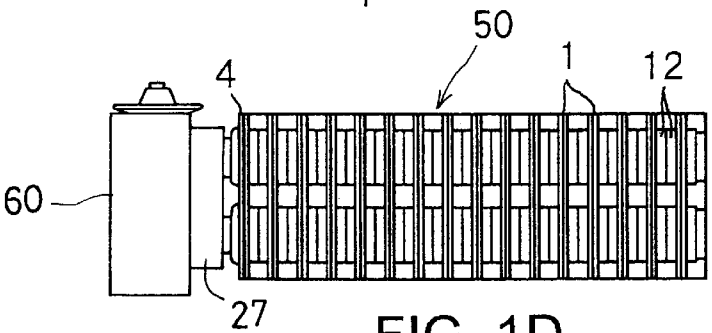

The flange 27 is further connected to a block expansion valve 60, which is, for example, an automatic thermoexpansion valve. As shown in FIG. 1C, the expansion valve 60 has a refrigerant inlet port 61 and a refrigerant outlet port 62, and it is fixed to the flange 27 in such a manner that the refrigerant inlet port 61 corresponds to the forward refrigerant input port 231, while the refrigerant outlet port 62 corresponds to the return refrigerant output port 242.

The refrigerant flows from the inlet port 61 of the expansion valve 60 into the end plate unit 4 via the forward refrigerant input port 231, passes through the forward passage 230, and flows into the core body 50 via the forward refrigerant output port 232 of the middle end plate 23 and the pipe 21*a* of the inner end plate 21. When flowing through the forward refrigerant passage 230, the refrigerant branches off into the sub-passages 230*a*. At this time, the flowing ratios of the two sub-passages 230*a* may not be even. However, because the two sub-passages 230*a* communicate with each other at the opening passage 236, the two flows are uniformly mixed with each other at the opening 236, and flow into the core body 50 via the forward refrigerant output port 232. This arrangement allows an efficient heat exchange, and improves the evaporation ability.

On the other hand, the return refrigerant flows out of the core body 50 into the return refrigerant passage 240 via the return a refrigerant input port 241 of the end plate unit 4. The refrigerant branches off into the two sub-passages 240*a*, passes through the return refrigerant output port 242, and reaches the refrigerant outlet port 62 of the expansion valve 60. At this time, the two flows in the two return sub-passages 240*a* are uniformly mixed with each other at the opening 246, and flow through the return refrigerant output port 242 with a uniform distribution, whereby a satisfactory evaporation ability can be achieved.

The forward and return passages 230 and 240 are reinforced bad the partitions 235 and 245. Thus, a satisfactory pressure-resistance is obtained, while a sufficient cross-sectional area of the passage is maintained.

Figure 11B:
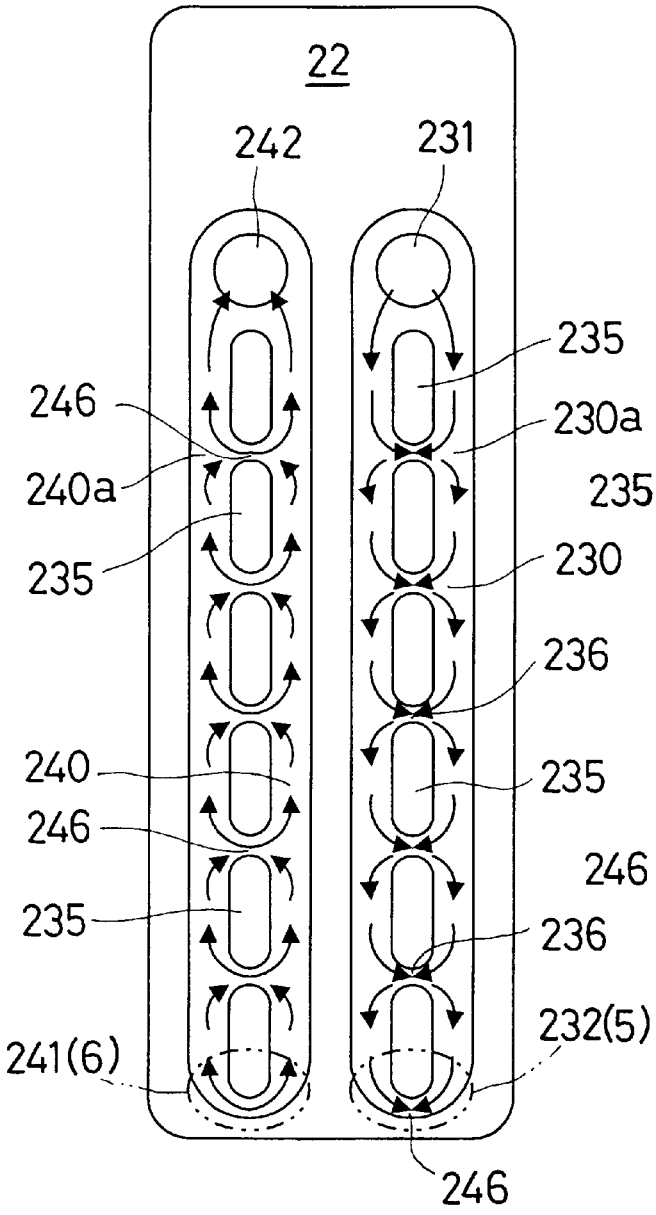
FIGS. 11A and 11B illustrate modifications of the outer end plate of FIG. 10.
Figure 11A:
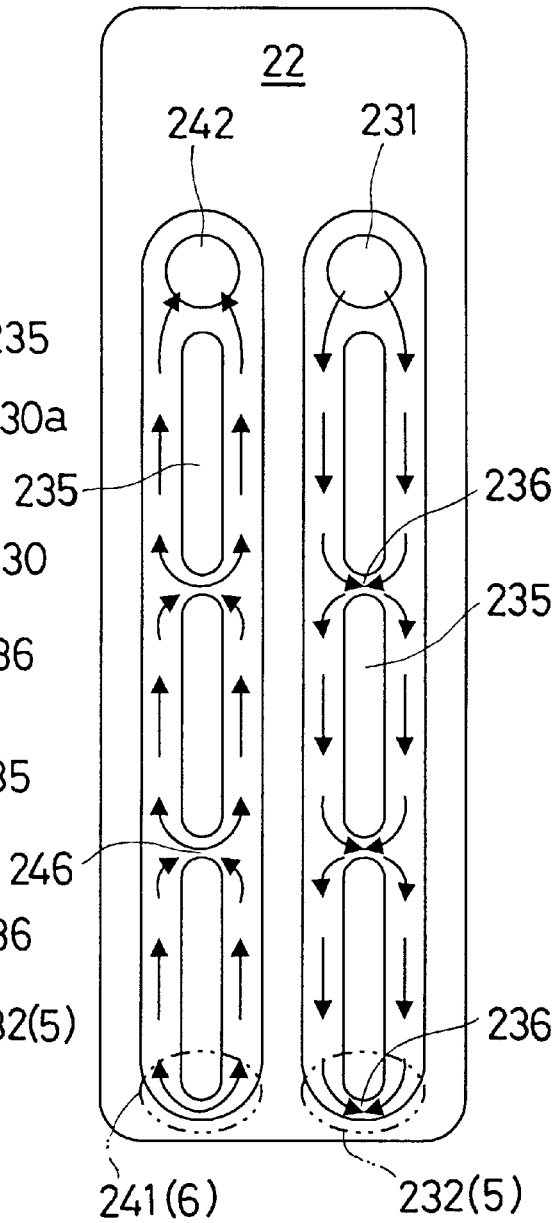

Although, in the embodiment, the opening passages 236 and 246 are formed at the end of the partitions 235 and 245, the invention is not limited to this example. For example, the opening passages 236 and 246 may be formed in the middle of the partitions 235 and 245, as shown in FIGS. 11A and 11B. Furthermore, a plurality of opening passages may be formed in each of the partitions 235 and 245.

The shapes of the forward refrigerant passage 230 and the return refrigerant passage 240 may not be necessarily the same.

Figure 13:
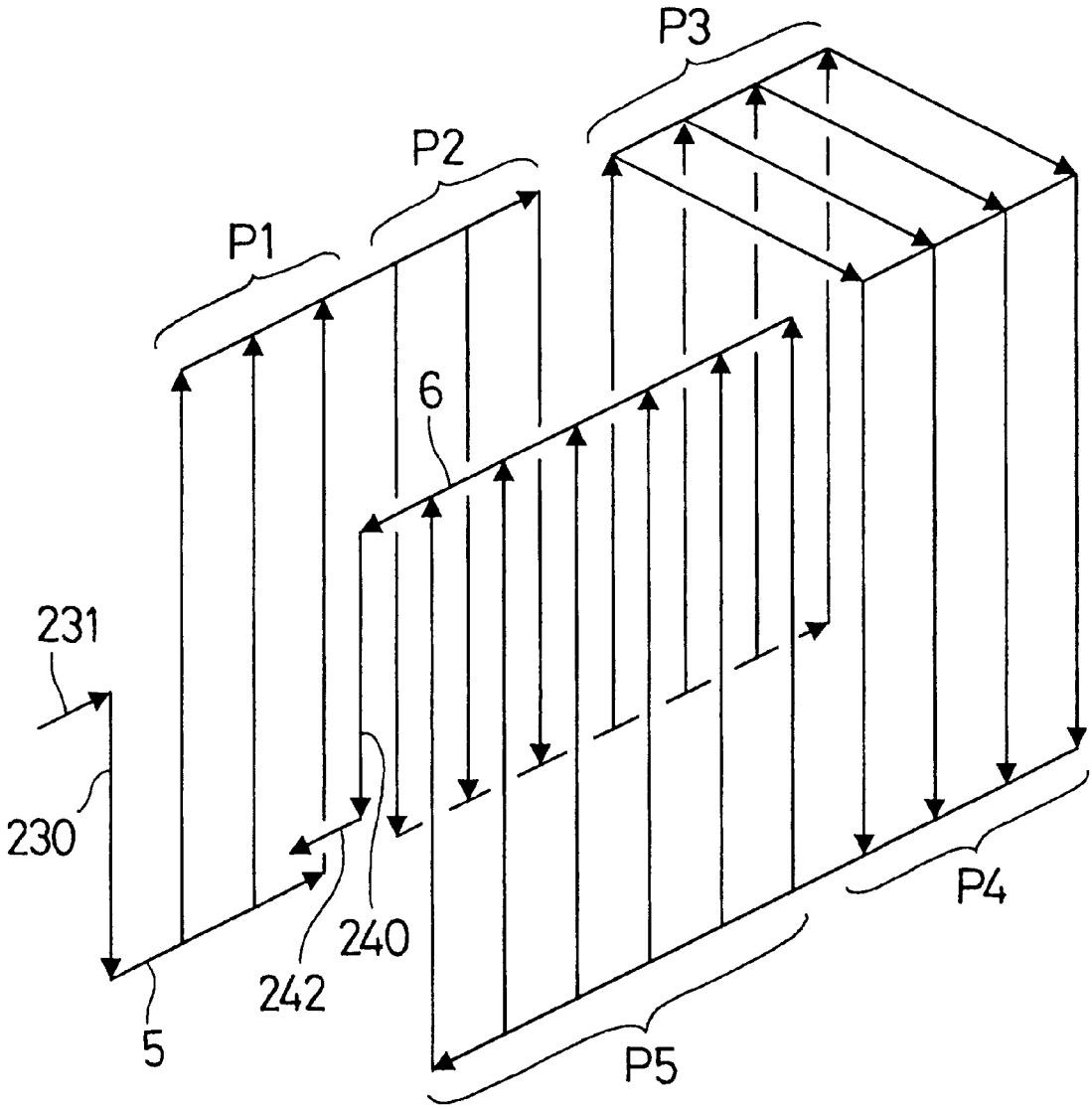
FIG. 13 shows the refrigerant flow path of a modification of the stack type evaporator in a perspective view.

In the embodiment, the forward and return refrigerant passages 230 and 240 are parallel to each other in the end plate unit in accordance with the refrigerant paths P1 through P4 shown in FIG. 5. However, the invention is not limited to this arrangement. FIG. 13, illustrates an modification of the refrigerant path, in which paths P1 through P3 are positioned in the downstream side of the core body 50, and the paths P4 and P5 are positioned in the upstream side. In this case, the end plate unit 4 is designed so that the forward refrigerant flows downward through the passage 230 and that the return refrigerant flows upward through the passage 240.

Figure 14:
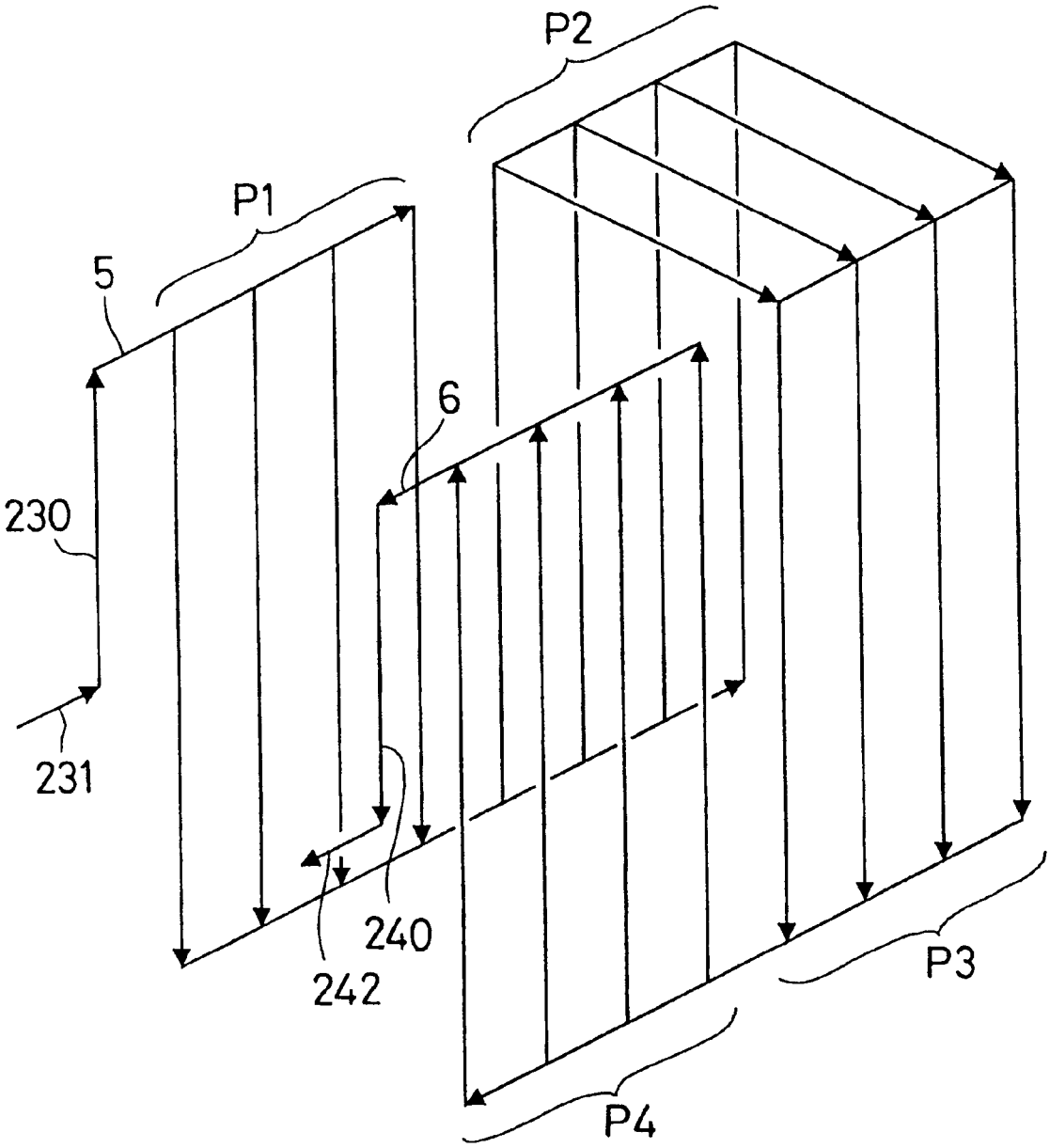
FIG. 14 shows the refrigerant flow path of another modification of the stack type evaporator in a perspective view.

In FIG. 5, the refrigerant that has just flowed into the core body 50 goes up along the path P1, and the return refrigerant immediately before flowing out of the core body 50 goes down along the path P4. However, the path can be modified into one shown in FIG. 14. In FIG. 14, the refrigerant that has just flowed into the core body 50 goes down along the path P1, while the return refrigerant immediately before flowing out of the core body 50 goes up along the path P4. Off course, the path structure is not limited to these examples having paths P1 through P4, or P1 through P5, and still other modifications can be made by those skilled in the art.

Figure 4A:
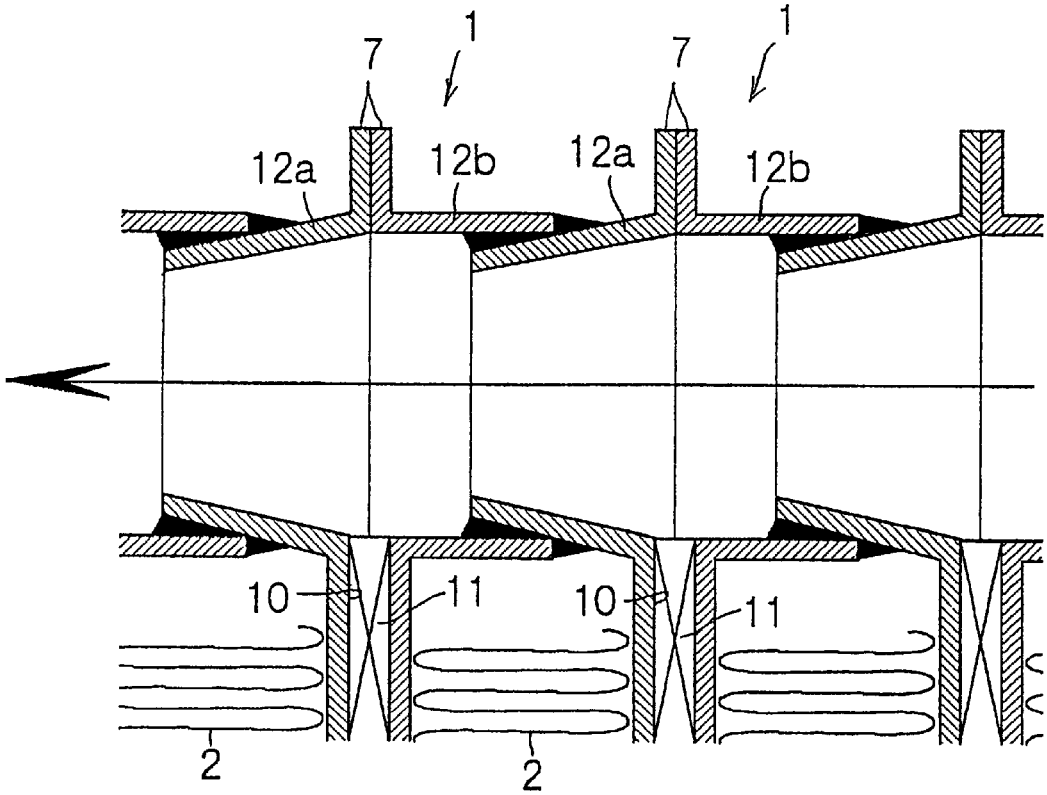
FIGS. 4A and 4B illustrate modifications of the tank connection structure shown in FIG. 3.
Figure 4B:
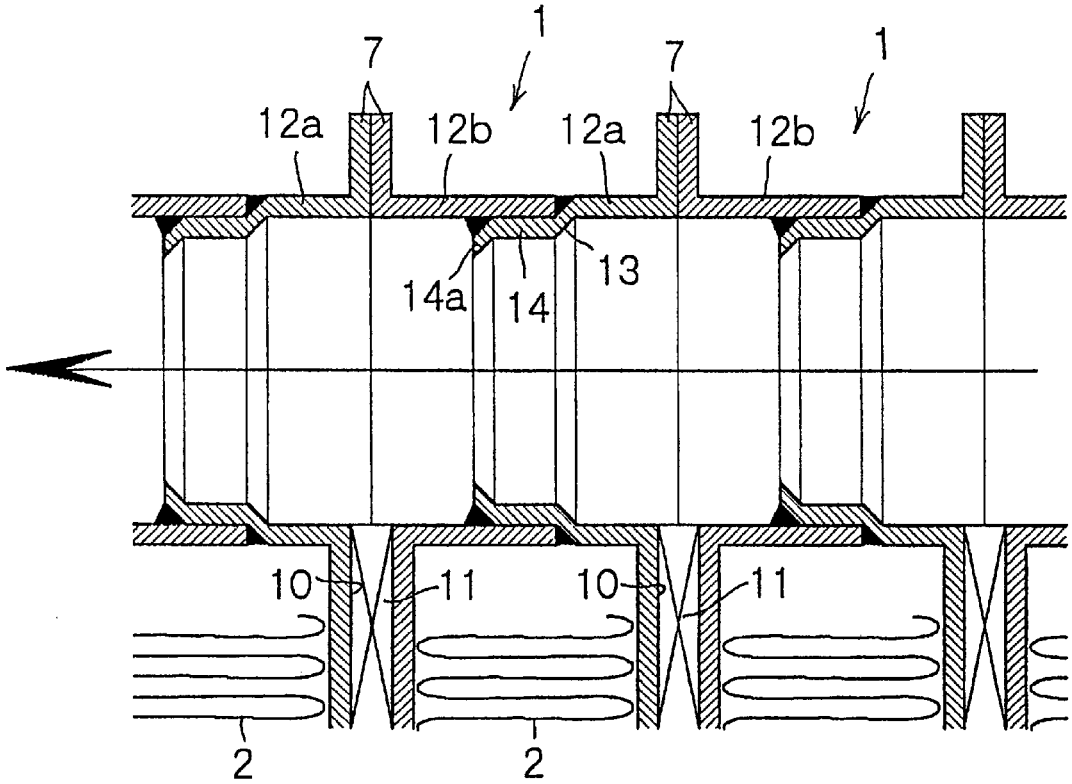

In the embodiment, the tank 12*a* has a shoulder 13 so that it is appropriately fit into the corresponding tank 12*b*, as shown in FIG. 3. As a modification, the end portion of the tank 12*a* may be gently tapered without forming a shoulder 13. This can achieve the same effect, and the end portion of the tanks 12*a*, having a slightly reduced diameter, is appropriately fit into the corresponding tank 12*b*, as shown in FIG. 4A. FIG. 4B illustrates still another modification, in which the tank 12*a* has a shoulder 13 in the middle, and the end portion extends with a constant diameter up to the rim 14*a*. The rim 14*a* slightly bends inward in order to facilitate the insertion or the tank 12*a* into the tank 12*b*. After the tank 12*a* is fit into the tank 12*b*, they are brazed, and connected into one unit.

Although, in the embodiment, the flat and plate-like tubular element 1 have the tanks projecting both sides, it may have a one-side tank structure, in which only one of the formed plate pair has the tanks and a U-shaped passage is formed inside the tubular element 1.

Experimental Test:

A stack type evaporator according to the invention and a conventional stack type evaporator are prepared for a comparison test. The conventional stack type evaporator does not have an inner fin inside the flat tubular element. Instead, in order to increase the heat-transfer area, a rib is formed inside the recess of the formed plate, extending along the longitudinal direction. The edge of the rib comes into contact with the bottom of the recess of the other formed plate when these two formed plates are put together. This conventional stack type evaporator is of a cross-flow type, in which only one passage is formed inside the tubular element, and the refrigerant flows up and down along this single passage. This is different from the evaporator of the present invention, in which two passages are formed in the tubular element in order to allow the refrigerant to shift in a direction opposed to the air flow when it returns along the return passage. In addition, each tank of the conventional stack type evaporator has an annular flange extending inward, which faces the annular flange of the corresponding tank of the adjacent formed plate of the next tubular element. When connecting the tanks, the annular flanges of the opposed tanks are put together. Two conventional evaporators are prepared, one having a width of the tubular element of 75 mm (comparison example 1) and the other having a width of the tubular element of 60 mm (comparison example 2). The evaporator of the present invention has a width of 60 mm (actual example 1). The number of flat and plate-like tubular elements is twenty three in both the comparison and actual examples.

Figure 12:
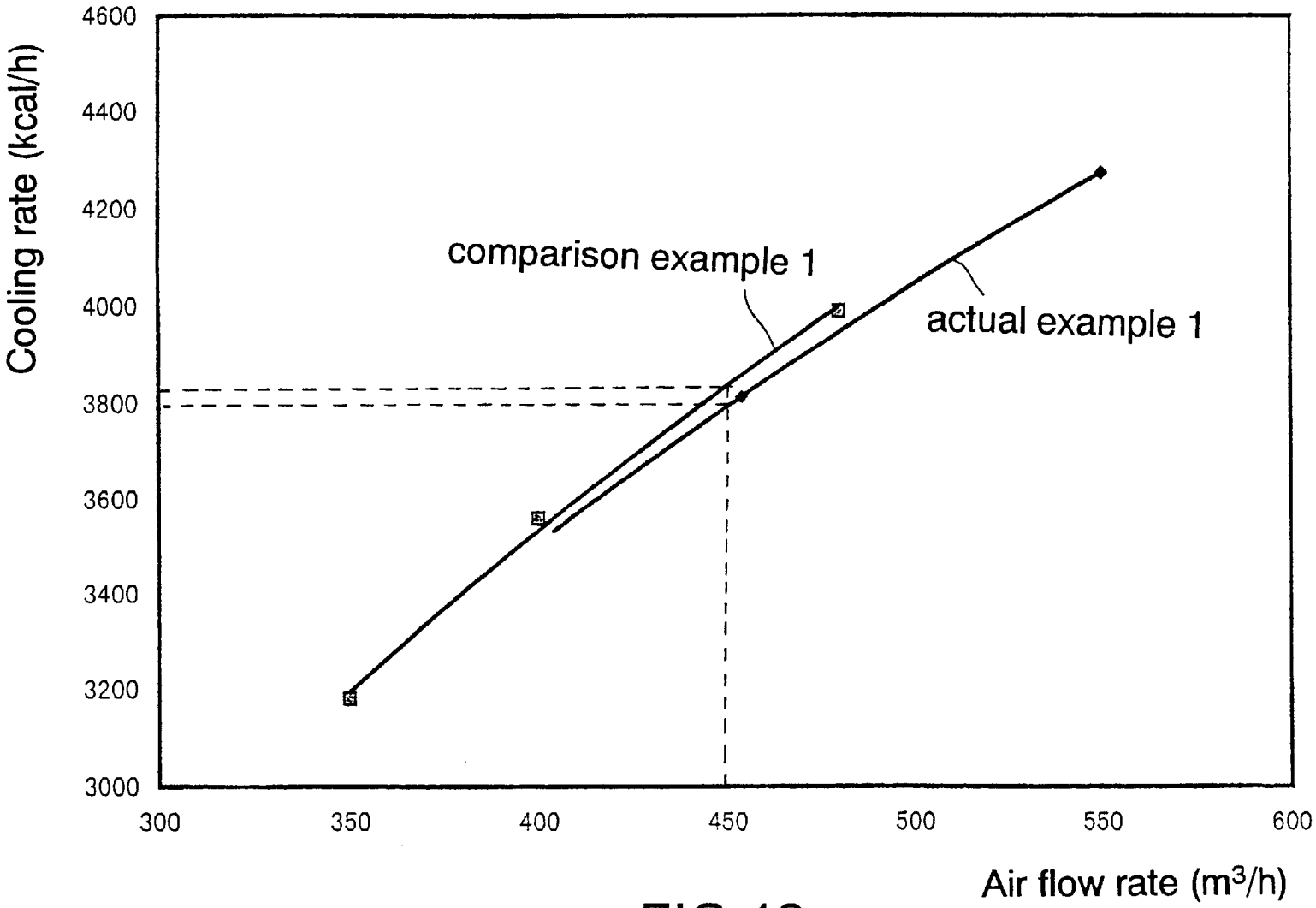
FIG. 12 is a graph showing the cooling ability of the stack type evaporators according to the embodiment, as well as the cooling ability of the comparison example, as a function of the amount of wind.

Assuming the heat-transfer area for the refrigerant in the comparison example 1 is 100, that of the comparison example 2 is 71, and that of the actual example 1 is 84. Assuming the heat-transfer area for the air in the comparison example is 100, that of the comparison example 2 is 80, and that of the actual example 1 is 86. Assuming the refrigerant passage resistance at a flow rate of 100 Kg/h in the comparison example 1 is 100 (0.19 kg/cm$^2$), that of the comparison example 2 is 211 (0.40 kg/cm$^2$), and that of the actual example 1 is 137 (0.26 kg/om$^2$). From these test results, it is confirmed that the stack type evaporator of the invention can achieve sufficiently large heat-transfer areas for both the refrigerant and the air, while the entire size is reduced. In addition, the refrigerant passage resistance can be decreased. FIG. 12 is a graph showing the cooling rates of the evaporators of the comparison example 1 and the actual example 1. At an air flow rate of 450 m$^3$/h, the cooling rate of the comparison example 1 (having a width of 75 mm) is 3820 Kcal/h, and that of the actual example 1 (having a width of 60 mm) is 3800 Kcal/h. Thus, the compact evaporator according to this invention can achieve substantially the same cooling effect as the larger evaporator of the comparison example 1.

As has been described above, in the stack type evaporator according to the invention, short cylindrical tanks are formed at the ends of each formed plate in such a manner that the tanks project outward when a pair of formed plates are put together to comprise a flat tubular element. When a plurality of tubular elements are stacked, at least the end portion of the tank is fit into the corresponding tank of the adjacent formed plate of the next tubular element, whereby the entire evaporator can be made compact. In addition, the effective core area required for heat exchange between the refrigerant and the air can be increased, and the pres,sure loss in the air can be reduced. This tank connection structure allows smooth flow of the refrigerant between tubular elements with less passage resistance, whereby high cooling ability can be achieved.

The refrigerant flow shifts from the downstream path to the upstream path in the direction opposed to the air flow that passes through the evaporator core in the direction perpendicular to the stack direction. This arrangement can improve the heat-exchange rate, as compared with a conventional cross-flow type evaporator.

Furthermore, an inner fin, which was manufactured separately from the formed plate, is placed in the refrigerant passage formed inside t,he flat tubular element. This arrangement can achieve a larger heat-transfer area for the refrigerant inside the passage, as compared with the tubular element having an inner fin formed integratedly with, for example, the formed plate by pressing.

Because a flat end plate unit having refrigerant passages therein is attached to the side face of the evaporator core, the expansion valve can be fixed directly to the end plate unit. In this case, it is not necessary to provide an input/output pine between the expansion valve and the evaporator core and, accordingly, the entire evaporator is shaped simple and compact. The space required to install this evaporator can be reduced.

A partition is placed in the forward refrigerant passage to divide the passage into sub-passages. This partition can reinforce the refrigerant passage, and a sufficient pressure-resistance can be obtained.

One or more opening passages are formed in the partition in order to allow the sub-passages to communicate with each other. The refrigerant flowing through the sub-passages can be mixed with each other evenly at the opening passages, and flows into the core body smoothly with a uniform distribution. This can allow efficient heat exchange and improve the evaporation ability.

The terms and expressions used in this specification are only for explanatory purposes, not for limitation of the invention, and they do not exclude the equivalents of the disclosed features. It should be appreciated that many changes and substitutions can be made by those skilled in the art without departing from the scope of the invention which is defined by the appended claims.

What claimed is:

1. A stack type evaporator, comprising:

a core body having a plurality of flat and plate-like tubular elements stacked in the thickness direction with an outer fin disposed between any two adjacent tubular elements, each tubular element including a pair of formed plates and having flat surfaces; and short cylindrical tanks formed in the end portions of each formed plate so as to project outward of the flat surface of the tubular element and for connecting the plurality of tubular elements, each tank of the formed plate having end portions connected in generally telescoping relation with end portions of a corresponding tank formed in the adjacent formed plate of the next tubular element, thereby allowing the inner spaces of the tubular elements to communicate with each other.

2. The stack type evaporator according to claim 1, wherein each tubular element has two or more refrigerant passages extending side by side along the longitudinal direction, the passages including a downstream passage and an upstream passage with respect to the air flowing through the core body in a direction perpendicular to the stacked direction, and wherein a refrigerant flows from the downstream passage into the upstream passage.

3. The stack type evaporator according to claim 1, wherein a refrigerant passage is formed inside the tubular element, and an inner fin is placed in the refrigerant passage.

4. A stack type evaporator, comprising:

a core body having a plurality of flat and plate-like tubular elements stacked in the thickness direction with an outer fin disposed between any two adjacent tubular elements, each tubular element having a pair of formed plates; and short cylindrical tanks formed in the end portions of each formed plate so as to project outward of the tubular element and for connecting the plurality of tubular elements, each tank of a formed plate being fit into the corresponding tank formed in the adjacent formed plate of the next tubular element, thereby allowing the inner spaces of the tubular elements to communicate with each other;

the core body having a refrigerant inlet port formed on a side face of the core body for introducing a refrigerant into the tubular elements, and a refrigerant outlet port formed on said side face of the core body for discharging the refrigerant from the tubular elements;

an end plate unit being provided to said side face of the core body, the end plate unit having a forward refrigerant passage and a return refrigerant passage inside it, a forward refrigerant input port being formed on one end of the forward refrigerant passage so as to open outward, a return refrigerant output port being formed on said one end of the return refrigerant passage so as to open outward, a forward refrigerant output port being formed on the other end of the forward refrigerant passage so as to be connected to the refrigerant inlet port of the core body, and a return refrigerant input port being formed on the other end of the return refrigerant passage so as to be connected to the refrigerant outlet port of the core body; and an expansion valve being fixed to the outer face of the end plate unit, the expansion valve having a refrigerant inlet port connected to the forward refrigerant input port, and a refrigerant outlet port connected to the return refrigerant output port.

5. The stack type evaporator according to claim 4, wherein the forward refrigerant passage of the end plate unit is divided into a plurality of sub-passages by partitions extending along the forward refrigerant passage.

6. The stack type evaporator according to claim 5, wherein one or more opening passages are formed in the partitions, which allow the plurality of sub-passages to communicate each other.

* * * * *